United States Patent [19]

Goode

[11] 3,934,854

[45] Jan. 27, 1976

[54] APPARATUS FOR WINDING PILOT LINES

[75] Inventor: Robert W. Goode, Arlington, Tex.

[73] Assignee: Hydra Dyne Corporation, Forth Worth, Tex.

[22] Filed: July 17, 1974

[21] Appl. No.: 489,397

[52] U.S. Cl. ..... 254/134.3 R; 242/86.5 R

[51] Int. Cl.[2] ..... F21C 29/16

[58] Field of Search ..... 242/86.5 R, 86.61, 86.8, 242/158 R, 158.4, 157 R; 254/134.3 R, 134.3 FT, 134.3 CL

[56] References Cited

UNITED STATES PATENTS

| | | | |
|---|---|---|---|
| 2,674,013 | 4/1954 | Place | 242/158.4 R |
| 3,000,588 | 9/1961 | Brady | 254/134.3 R |
| 3,134,555 | 5/1964 | Baker | 242/86.5 R |
| 3,216,636 | 11/1965 | Kothe | 254/134.3 CL |
| 3,458,152 | 7/1969 | Barkley | 254/134.3 R |

FOREIGN PATENTS OR APPLICATIONS

| | | | |
|---|---|---|---|
| 725,780 | 11/1966 | Italy | 254/134.3 R |

*Primary Examiner*—Al Lawrence Smith
*Assistant Examiner*—Robert C. Watson
*Attorney, Agent, or Firm*—Joseph H. Schley, Esq.; Thomas L. Cantrell, Esq.

[57] ABSTRACT

Apparatus is provided for winding elongated material in the form of pilot lines upon axially aligned drums rotatably mounted on a self-contained mobile trailer which has a horizontal rail extending longitudinally thereof in spaced parallel relation to the coaxial drums. A bull wheel or capstan device is slidably mounted for reciprocation upon the rail to guide and advance each pilot line onto the peripheral winding surface of each drum.

6 Claims, 3 Drawing Figures

APPARATUS FOR WINDING PILOT LINES

BACKGROUND OF THE INVENTION

1. Field of Invention

The present invention relates to apparatus for winding elongated material onto drums and, more particularly, to portable apparatus for winding pilot lines upon drums to facilitate the handling of pulling lines or the like used in the stringing of power transmission conductors.

2. Technical Considerations

Power transmission conductors are generally suspended from support towers spaced along a path or route spanning vast sections of land. The conductors are often very large in diameter and therefore relatively heavy and cumbersome to handle. When the conductors are strung along their transmission paths, relatively large pulling forces are required to draw them off of their reels and over their support towers. To facilitate this effort, a socalled pulling line is first strung over the transmission path, and then the end of the pulling line is attached to the leading end of the transmission conductor and pulled back across the transmission path by a heavy pulling machine to string the transmission conductor.

As mentioned above, the transmission conductors are relatively heavy and therefore the pulling lines used for stringing them must be suitably strong. Pulling lines are generally steel cables, usually heavy and cumbersome to handle and, therefore, the pulling lines are strung by a relatively lighter pilot lines which are less cumbersome to handle. Each pilot line is generally made of strong, flexible, lightweight dielectric material such as polypropylene, and its flexibility provides easier handling in threading it through the blocks of the individual support towers to serve as a lead line in defining the ultimate transmission conductor path.

When a pilot line is positioned along the transmission path, its end is attached to the leading end of the pulling line for drawing the pulling line into place. Apparatus for handling pilot lines and stringing pulling lines must be capable of delivering pulling forces of many thousand pounds because of the size of the pulling line. Conventional apparatus has included a plurality of reels arranged side by side in coaxial relationship with a level wind means positioned before each reel. Such reels having individual clutch and brake mechanisms are usually rotated by a common drive shaft. Such a reeling arrangement has operational shortcomings in that as the pilot line is tightened by the reel rotation, it stretches, resulting in a reduction of the line diameter. The reduced diameter increases the force in pounds per square inch of the line upon the reel. The increase in force applied if often sufficient to severely damage underlying convolutions of line and to crush the reel.

Some of the prior art constructions have attempted to eliminate the crushing problem inherent in the stretching of lines by utilizing a bull wheel winder system. In such cases, the bull wheel system interposes the necessary reeling tension, accommodates the stretching of the line and supplies it at relatively light tension to the take-up elements. Generally in such constructions, a single bull wheel system is utilized in conjunction with a separate level wind apparatus for each drum. Level wind equipment is common in the prior art and generally comprises apparatus for guiding elongated material onto a spool or drum driven in rotation to reel in the elongated material.

In one prior art construction, the bull wheels are fixed in a position above a plurality of rotatably mounted drums arranged one behind the other with their axes in spaced, parallel alignment. The pilot lines are pulled in by the bull wheels and guided onto each reel by the individual level winds. Such an arrangement has operational and structural shortcomings, in that individual level wind apparatus is necessary and interference between pilot lines of adjacent reels is frequent. Also, since the bull wheel system must be positioned above the drums, an overturning moment on the apparatus is produced during the pulling of the lines and becomes a limiting factor in the operation.

Inherent in population growth is the expansion of cities and towns and the increased requirement for electricity. The need has thus been fostered for more efficient and powerful apparatus for facilitating the stringing of power transmission conductors. Such apparatus primarily must be mobile and compact to facilitate transportation with emphasis on safety, efficiency and economy in the stringing operation.

SUMMARY OF THE INVENTION

One object of the present invention is to provide a new and improved apparatus for winding elongated material onto a plurality of take-up elements.

Another object of the present invention is to provide a new and improved portable apparatus for winding pilot lines upon a plurality of driven drums.

It is a further object of the present invention to provide a new and improved portable apparatus for winding pilot lines upon drums without separate feed level control apparatus.

It is a further object of the present invention to provide a new and improved portable apparatus for winding pilot lines upon a plurality of coaxial drums positioned side by side, utilizing a single tensioning capstan.

It is yet another object to provide a portable apparatus for winding pilot lines onto a plurality of drums which apparatus is partially collapsible facilitating storage and transportation.

The new and improved apparatus for winding elongated material upon a plurality of take-up elements includes an elongated guide member mounted on a base in spaced parallel relation to the axis of the take-up element, means for rotating each take-up element, a tensioning capstan for receiving and advancing the elongated material onto the take-up element, and means for slidably mounting the tensioning capstan for rectilinear movement on the elongated guide member between a plurality of pairs of predetermined limits, the distance between adjacent limits being determined by the length of the winding surface of the take-up element.

Elongated material in the form of pilot lines used in handling pulling lines for stringing transmission conductors is fed through the tensioning capstan which may be of the so-called bull wheel winder type, well known in the prior art. The bull wheel winder is a tensioning device comprising one or more bull wheels having a plurality of grooves arranged to receive several windings of elongated material therearound. Sufficient tension is provided by the bull wheel system to draw in the line and guide it onto the take-up element or drum. The drum is driven in take-up rotation by driving means which frictionally engages the drum and maintains relatively light tension in the line so as to facilitate the use of lighter weight and, therefore, less expensive drums.

The capstan reciprocates in a path parallel to the axis of drum during the reeling operation, thereby acting as a feed level control, or distributor, to provide uniform layers of convolutions of line thereupon. The reciprocating movement occurs between limits defined by the axial length of the winding surface of the drum, and may be controlled manually. The distributor capability of the capstan allevaites the necessity of more expensive and complex independent level wind apparatus.

Maximum utilization of the single tensioning capstan is accomplished by positioning a plurality of drums in end to end axial alignment upon the base. The translational capability of the capstan upon the elongated guide provides for positioning of the bull wheels before a select drum for winding thereon.

In the present invention, only one drum at a time may be utilized for winding in lines under heavy loading, but all of the drums may be used at once for paying off line. This capability is possible because the drum take-up drive is independent of the tensioning capstan, which is not needed during paying off of the line. This dual function of the present invention facilitates the handling of multiple pilot lines with increased efficiency.

The base of the apparatus in the present invention is in a form of a trailer adapted for towing by a motor vehicle. This feature allows positioning of the apparatus in the desired relation to the support towers of the transmission line path. For highway transportation, a section of the rail is designed to swing inboard of the trailer with the bull wheel system mounted thereon so as to reduce the overall width of the apparatus. It will therefore be appreciated that such apparatus as described herein will maximize the efficient performance of the stringing operation.

BRIEF DESCRIPTION OF THE DRAWINGS

The objects and various features of the present invention will be fully understood from the following detailed description of a preferred embodiment thereof, when read in conjunction with the accompanying drawings, wherein.

DETAILED DESCRIPTION

Figure 1:
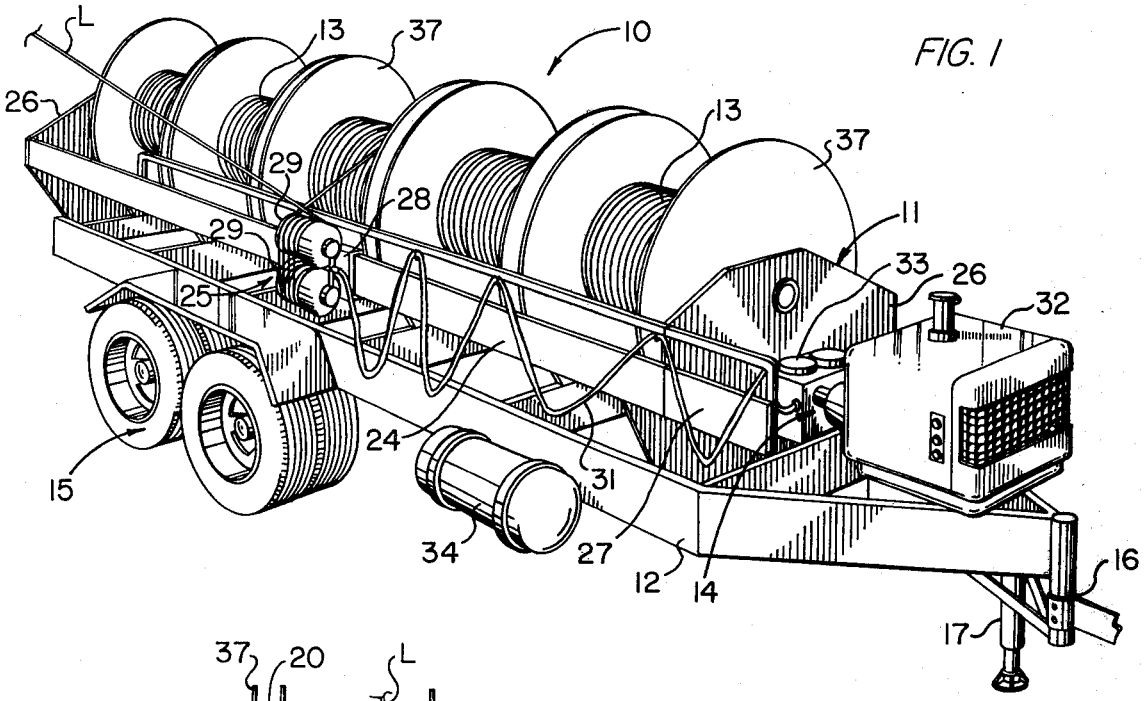
FIG. 1 is a perspective view of an apparatus for winding pilot lines onto a plurality of drums in accordance with the principles of the present invention.

Attention is first directed to FIG. 1, wherein a pilot line winding apparatus 10 comprises a self-contained winding unit 11 mounted on a trailer frame 12, thereby providing mobility for handling pulling lines used in stringing power transmission lines. In stringing these lines, mobility is essential in providing the capability of crossing rugged terrain and moving on open highways for attaining operative access to the transmission line path. Generally, three to five transmissions conductors or the like (not shown) will be strung. The present embodiment, therefore, includes a self-contained power unit 14 and an apparatus for supporting up to five pilot line drums 13—13 to facilitate maximum utilization of time and effort in the stringing of the pulling lines.

Frame 12 is an elongated horizontal structure designed as a base to support the winding unit 11 during operation and transportation and has conventional trailer wheels 15, disposed behind the center of gravity of winding unit 11 so as to facilitate a proper balance for towing the apparatus 10. Attachment means for towing behind a suitable motor vehicle (not shown) is provided through an adjustable trailer hitch 16 welded to a converging front end section of the frame 12. In this forward section frame 12, a retractable support leg 17, of the hydraulic jack-type commonly used on trailers, is provided to permit level positioning of the apparatus 10 during the stringing operation.

Figure 2:
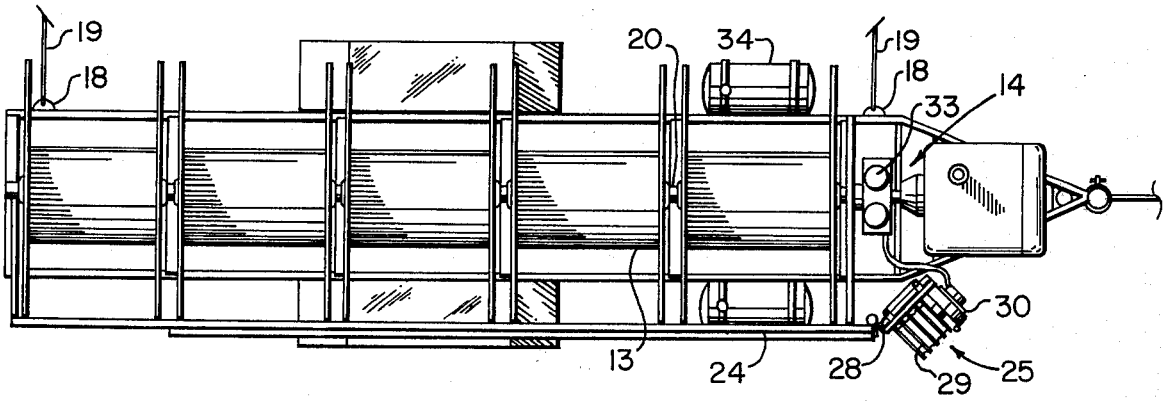
FIG. 2 is a top plan view of a portion of the apparatus of FIG. 1 particularly illustrating an inboard swinging feature of the bull wheel system for transportation.

As may best be seen in FIG. 2, a pair of side anchoring rings 18—18 are disposed at opposite ends of frame 12 for attachment to anchoring cables 19—19 thereby providing lateral stability for the apparatus 10 during the winding operation. A plurality of cradles or drum supports 20—20 of conventional design are mounted at spaced points along the length of the frame 12 to provide means for rotatably mounting the drums 13—13 in end-to-end coaxial alignment.

Fixedly positioned on and above the frame 12 is a horizontal support bar 23 and an elongated guide member or rail 24 extending substantially the length of the frame 12 in parallel alignment with the axes of the drums 13—13. Rail 24 is rigid and designed to support a tensioning capstan 25 mounted thereon. Upright structural braces 26—26 extend transversely of the frame 12 being secured thereto and to rail 24 by providing rigid support thereto from the side thereof facing the drums 13—13, permitting the capstan 25 to be slidably mounted for free translational movement on the outward side. A front end section 27 of the rail 24 is hingedly connected to the remainder of the rail and adapted for swinging inboard toward the center of the winding unit 11. Hinged section 27 facilitates the positioning of the capstan 25 for transportation as will be discussed in more detail below.

The capstan 25 is slidably mounted on the outward side of the rail 24 by a carriage 28, adapted for rectilinear movement. Carriage 28 is preferably a rigid U-shaped frame supported on the rail through suitable roller bearings or the like capable of supporting relatively heavy loads. The carriage 28 supports the capstan 25 during the reeling operation, while at the same time facilitating controlled rectilinear movement on the rail 24.

The capstan 25 is preferably of the bull wheel winding type, well known in the winding and reeling art and includes a pair of bull wheels 29—29 which are rollers formed with peripheral grooves or flanges therearound. The bull wheels 29—29 are arranged in parallel axial alignment and designed to receive windings of elongated material therearound, maximizing surface contact with a minimum of relative movement of the material on the wheels 29—29. Each bull wheel 29 is coupled to a suitable motor 30 which may be of the electric or hydraulic type for driving the bull wheels 29—29 in uni-directional, synchronous rotation.

Power is supplied to the motors 30—30 through a suitable power line 31, flexible in construction and suspended by the bar 23 and facilitating the movement of the capstan 25. The power for the motors 30—30 is supplied by the power unit 14 which includes an internal combustion engine 32 coupled to an appropriate energy generator 33. The power unit 14 is preferably adapted to supply hydraulic fluid and therefore the generator 33 is of the conventional fluid pump type, supplying hydraulic fluid flow through the line 31, having multiple flow channels therein. In furtherance of the self-contained nature of the apparatus 10, fuel tanks 34 are positioned along the frame 12 facilitating the storage of diesel or gasoline for the engine 32.

The capability of incremental, bi-directional rectilinear movement of the capstan 25 upon rail 24 is essential for operation of apparatus 10. Rail 24 serves as a track, or guide, upon which the capstan 25 may be slidably positioned for bi-directional rectilinear movement adjacent to each drum 13 for guiding the wound material thereon. As may be seen from FIG. 1, the rail 24 and the capstan 25 are disposed on the side of the drums from which direction a pilot line L is strung toward a transmission tower (not shown). Once positioned before one of the drums 13, the capstan 25 is induced to reciprocate between a pair of predetermined limits upon the rail as will be discussed below. The distance between adjacent limits is determined by the axial length of the winding surface of the drum 13. The distance between adjacent limits represent increments along the rail 24 on which the capstan 25 reciprocates. The reciprocal movement provides distribution of or feed level control for the material being wound upon the drums and a separate distributor is therefore not needed.

Bi-directional movement may be impartial to the carriage 28 and controlled manually. The reciprocating drive may be a conventional hand-operated mechanism (not shown) incorporated into the carriage 28 providing means for an operator to impart the force for backward and forward movement of the carriage. The operator provides constant feed control and means for compensating for any variations in the diameter of the pilot line produced from stretching or wear. The mechanism of carriage drive and control is preferably manual for this reason, although automatic means, for example, a conventional distributor driving and control system, may be utilized.

Additionally, a small hydraulic or electric motor 38 powered by the power unit 14 may be incorporated into the carrage 28 to supply the required driving energy to the carriage 28. The direction in which the carriage 28 moves may be controlled by manually operated switching or reversing means, represented in FIG. 3 by a lever 39, accessible to the operator at a zone under the bull wheel 29. This permits the operator to have direct control over the winding operation to position the capstan 25 adjacent to a selected drum 13 and to control the reciprocation of the carriage 28 to distribute uniform convolutions of line L upon each drum.

Figure 3:
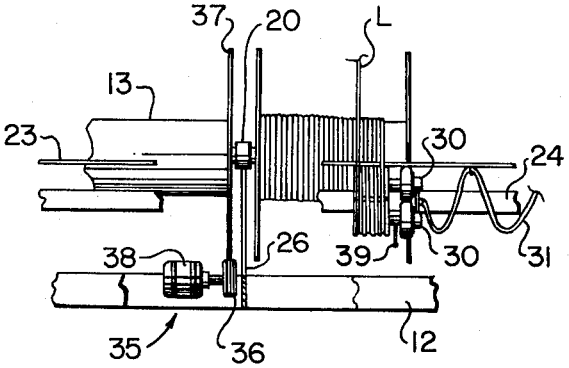
FIG. 3 is an enlarged, fragmentary, side elevational view of the apparatus of FIG. 1 illustrating the drum take-up driving means.

During the winding operation, the capstan 25 transmits the pulling force applied to line L directly through the rail 24, the frame 12, and the anchoring cables 19—19, facilitating the use of lighter weight drums 13—13 for pilot line storage. Moderate tension in the line L is also required between the drum 13 and the capstan 25. Sufficient tension to eliminate slack in the line L is necessary to provide uniform feed level control of the line onto each drum 13. Individual take-up drives 35—35 are therefore provided for the drums 13—13 wherein the requisite tension is provided by frictionally driving each drum with a drive wheel 36 which may be a pneumatic tire in frictional engagement with a flange 37 in each drum. Each tire 36 is coupled to and driven by a take-up motor 38 of the electric or hydraulic type powered by the power unit 14. Each take-up drive 35 is disposed on the frame 12 below the drum 13 and positioned to engage the drum as shown in FIG. 3, and the amount of tension is adjustable through torque control of the motor 38.

The take-up drives 35—35 provide not only the proper take-up tension but also facilitate controlled payoff of pilot line L from each drum 13. By imparting a drag force to the rotation of the drum through the frictional coupling therebetween, it is thus within the capability of the winding unit 11 to handle the payoff of lines L—L from a plurality of drums 13—13 at one time.

The front end section 27 of the rail 24 is hingedly mounted to swing inwardly toward the axis of rotation of the drums 13—13 facilitating movement and relocation of the apparatus 12. This collapsibility provision permits the capstan 25 to be positioned on the hinged section, swung inboard and secured. Such a position is necessary for highway transportation because in the operation position of the capstan 25 upon the rail 24, the bull wheels 29—29 may extend the apparatus 12 beyond the maximum width allowed for normal highway use. With the capstan suitably disposed inboard, safer and more efficient transportation is possible.

Due to the interpositioning of the bull wheel system to transmit the pulling force, the drums 13—13 may be lighter in construction than prior art reels and therefore more economical. Since a separate distributor system is not required, this, together with the frictional drive of the drums 13—13 permits simplification in the design of the apparatus 10. These features also facilitate the accommodation of any number of drums limited only by structural considerations of weight and transportation dimensional requirements. Safety is emphasized in operation and transportation and the amount of labor involved in both is reduced.

While the apparatus of the invention has been shown and described as being particularly advantageous in facilitating the stringing of transmission conductors and the reeling of pilot lines, it will be appreciated that it can be advantageous in the stringing and reeling of other materials. Similarly, while the particular embodiment shown and described is preferred, it will be obvious that various changes and modifications may be made therein without departing from the spirit and scope of the invention as defined in the following claims.

What is claimed is:

1. A portable reeling apparatus for winding elongated material upon a plurality of take-up elements mounted in side by side relationship, each element being rotatable about a horizontal axis in a substantially vertical plane parallel to the planes of rotation of the other elements, comprising:

a base for supporting the take-up elements;

means for rotating said take-up elements;

elongated guide means mounted on said base spaced from and parallel to the axis of each of said elements;

a bull wheel unit for receiving and advancing the elongated material toward a selected one of the take-up elements;

means for slidably mounting said bull wheel unit for rectilinear movement on said guide means; and drive means operable to position said bull wheel unit at desired positions along said guide means and to produce reciprocating movement of the bull wheel unit along the guide means relative to any selected one of said take-up elements for level winding the elongated material onto the selected one of said take-up elements as the elongated material is pulled by the bull wheel unit and the take-up element is rotated to store the elongated material.

2. The apparatus as defined in claim 1 wherein said elongated material is a pilot line material for facilitating the stringing of power transmission conductors, and said base forms part of a trailer adapted for towing attachment to a motor vehicle.

3. The apparatus as defined in claim 1 wherein said bullwheel unit comprises:

first and second bull wheels arranged in spaced parallel axial alignment for receiving spaced sections of the elongated material therearound; and first and second hydraulic motors coupled to said bull wheels are uni-directional, synchronous rotation of said bull wheels to advance the elongated material.

4. The apparatus as defined in claim 1 wherein said elongated guide means includes an end section hingedly mounted to swing toward the axis of the take-up elements for positioning said bull wheel unit inwardly said base for transportation of the apparatus.

5. The apparatus as defined in claim 1 wherein said means for rotating said take-up elements includes a plurality of rubber tired wheels each in frictional engagement with a portion of an associated take-up element and means for driving said wheel in a direction to tend to rotate the take-up element in a direction to take up line.

6. An apparatus for reeling pilot lines, of the kind used in facilitating the stringing of transmission conductors, onto a plurality of drums mounted in side by side relationship, each element being rotatable about a horizontal axis in a substantially vertical plane parallel to the planes of rotation of the other elements, comprising:

a wheeled carrier and means for rotatably supporting the drums on the carrier;

a plurality of take-up drive wheels, each positioned adjacent an associated drum and in frictional engagement therewith for imparting rotary motion thereto;

an elongated guide rail rigidly mounted on said carrier spaced from and parallel to the axis of each of the drums mounted thereon, said guide rail having a hingedly mounted front end section for swinging toward said axis of each of said drums;

first and second bull wheels arranged in spaced parallel axial alignment for receiving spaced sections of pilot line therearound;

first and second hydraulic motors coupled to said bull wheels for unidirectional synchronous rotation of said bull wheels to advance the pilot line received therearound;

a carriage for slidably mounting said bull wheels and said motors upon said rail for rectilinear movement thereupon; and drive means operable to position said carriage and bull wheels on the guide rail and produce reciprocating movement of the carriage and bull wheels along the guide rail relative to any selected one of said plurality of drums for level winding the pilot line onto the selected one of the drums as the pilot line is pulled by the bull wheels and the selected drum is rotated by the associated drive capstan to store the pilot line.

* * * * *